US009171521B2

(12) United States Patent
Pui

(10) Patent No.: US 9,171,521 B2
(45) Date of Patent: Oct. 27, 2015

(54) TUNING DISPLAY DEVICES

(75) Inventor: Boon Hean Pui, Kuala Lumpur (MY)

(73) Assignee: PLASTIC LOGIC LIMITED, Cambridge (GB)

( * ) Notice: Subject to any disclaimer, the term of this patent is extended or adjusted under 35 U.S.C. 154(b) by 121 days.

(21) Appl. No.: 13/702,034

(22) PCT Filed: Jun. 3, 2011

(86) PCT No.: PCT/EP2011/059221
§ 371 (c)(1),
(2), (4) Date: Feb. 14, 2013

(87) PCT Pub. No.: WO2011/151458
PCT Pub. Date: Dec. 8, 2011

(65) Prior Publication Data

US 2013/0135279 A1 May 30, 2013

(30) Foreign Application Priority Data

Jun. 4, 2010 (GB) ..... 1009403.5

(51) Int. Cl.
*G09G 5/00* (2006.01)
*G09G 3/20* (2006.01)
*G09G 3/34* (2006.01)

(52) U.S. Cl.
CPC ..... *G09G 5/001* (2013.01); *G09G 3/20* (2013.01); *G09G 3/344* (2013.01); *G09G 2320/0219* (2013.01); *G09G 2320/0693* (2013.01)

(58) Field of Classification Search
USPC ..... 345/211
See application file for complete search history.

(56) References Cited

U.S. PATENT DOCUMENTS

| | | | | |
|---|---|---|---|---|
| 7,439,949 | B2 * | 10/2008 | Shikina et al. | 345/107 |
| 2007/0057975 | A1 | 3/2007 | Oh et al. | |
| 2007/0085784 | A1 * | 4/2007 | Liu | 345/77 |
| 2007/0139343 | A1 | 6/2007 | Wang et al. | |
| 2009/0153457 | A1 | 6/2009 | Kato | |
| 2009/0322664 | A1 | 12/2009 | Baek | |

FOREIGN PATENT DOCUMENTS

| | | | |
|---|---|---|---|
| JP | 2003255906 | A | 9/2003 |
| JP | 2010026393 | A | 2/2010 |
| WO | 2011/064578 | A1 | 6/2011 |

OTHER PUBLICATIONS

British Search Report for GB 1009403.5 dated Aug. 25, 2011.
Office Action issued in corresponding Japanese Patent Application No. 2013-512939 dated May 12, 2015.

* cited by examiner

*Primary Examiner* — Charles V Hicks
(74) *Attorney, Agent, or Firm* — Sughrue Mion, PLLC

(57) ABSTRACT

A technique comprising: determining a correction to a drive voltage for the front plane common electrode of a first display device according to the result of one or more measurements of an optical property for the first display device and the result of one or more measurements of said optical property for one or more other devices including an optical medium having the same optical response as the first display device.

8 Claims, 3 Drawing Sheets

TUNING DISPLAY DEVICES

The present invention relates to a technique for tuning display devices. In one embodiment, it relates to tuning the bias voltage applied to a front plane common electrode on the opposite side of a display medium to the pixel circuitry.

In active matrix displays, the control circuitry (otherwise referred to as the backplane) comprises an array of pixel electrodes whose voltages (pixel voltages) are independently controllable by a TFT array. Ideally, when a gate electrode of any TFT is switched between on and off states, the pixel voltage for the pixel electrode associated with that TFT would, even after the gate electrode is switched to the off state, continue to match the signal voltage at the time of the switch from the on state to the off state. However, in reality, parasitic capacitance between gate and pixel electrodes can result in a difference between the pixel voltage before and after the gate is switched between on and off states. This voltage difference is known as the kick-back (gate feedthrough) voltage, and can cause undesirable effects on the performance of a display such as flicker, image sticking and reduced uniformity of brightness.

One way of dealing with this problem and achieve reliable and optimal display drive is to provide an optically transparent conductive plane (referred to as the COM plane) on the side of the display medium opposite to the pixel electrodes, and apply a bias voltage (Vcom) to the front conductive plane that matches the actual display kickback voltage.

One way to determine the kickback voltage for a device is to electrically float the front plane conductor and measure the voltage that is induced at this front plane conductor when driving the backplane at known signal voltages.

Another way to determine the kickback voltage is to vary the front plane drive voltage (Vcom) for a fixed signal voltage (i.e. voltage applied to the source electrode(s)), until a minimum in the variation of the luminance of the display is observed. The variation of the luminance of the display can be measured by a camera or spectrophotometer.

It is an aim of the present invention to provide an alternative optical technique for determining an optimum voltage for a display device such as the front plane drive voltage (Vcom) mentioned above.

The present invention provides a method, comprising: determining a correction to a drive voltage for the front plane common electrode of a first display device according to the result of one or more measurements of an optical property for the first display device and the result of one or more measurements of said optical property for one or more other devices including an optical medium having the same optical response as the first display device.

In one embodiment, the method comprises determining from said measurements of said optical property for one or more other devices including an optical medium having the same optical response as the first display device a relationship between a change in the drive voltage for said front plane common electrode and a corresponding change in said optical property; measuring said optical property for the first display device at a first drive voltage for said front plane common electrode; and determining a correction to the first drive voltage on the basis of said relationship.

In one embodiment, said display device comprises a plurality of display pixels each controlled by a respective transistor including a gate electrode; and said optical property is a variation in the luminance of one or more of said display pixels after switching the gate electrode from an on state to an off state.

In one embodiment, said variation in luminance is due to a mismatch between a voltage induced on said one or more display pixels and said drive voltage applied to the front plane common electrode.

In one embodiment, said relationship between a change in the drive voltage for said front plane common electrode and a corresponding change in said optical property is a linear relationship.

In one embodiment, said relationship between a change in the drive voltage for said front plane common electrode and a corresponding change in said optical property is a non-linear relationship.

In one embodiment, said first drive voltage is selected according to the result of a measurement of an electrical property for the first display device.

Hereunder, an embodiment of the present invention is described, by way of example only, with reference to the accompanying drawings, in which.

Figure 1:
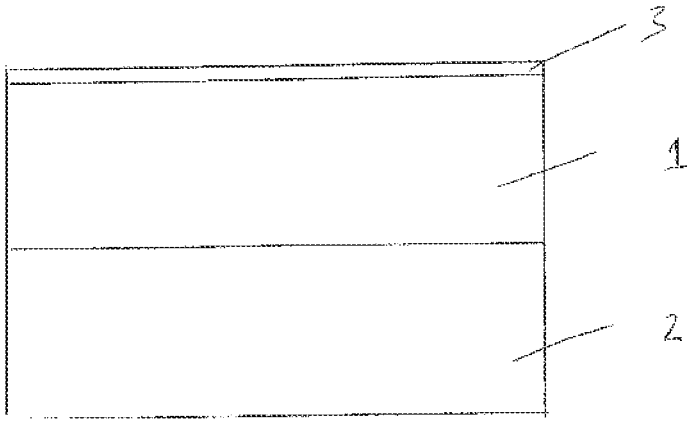
FIG. 1 illustrates a display device used as an example to explain an embodiment of the present invention.

With reference to FIG. 1, a display device used as an example to explain an embodiment of the present invention comprises an electrophoretic display medium 1 (frontplane) and pixel drive circuitry 2 (backplane), wherein the frontplane includes a conductive front plane (COM plane) 3 on the side opposite to the backplane. The pixel drive circuitry 2 includes an array of thin-film transistors (TFTs) by which the electric potential (pixel voltage) at each of an array of pixel electrodes located adjacent to the display medium 1 can be adjusted independently to create a variety of pixilated images in the display medium.

The pixel voltage for any given pixel electrode is generally determined by the signal voltage applied to the source electrode for the respective TFT when the gate electrode for the same TFT is switched from an off state into an on state. The gate electrodes are switched on and off at a frequency determining the frame rate or refresh rate of the display device. Ideally, for the period when a gate electrode is in an "off" state, the pixel electrode retains the electric potential it had at the time the gate electrode was most recently switched from an "on state" into the current "off" state. However, because of parasitic capacitance between the pixel electrode and the gate electrode of a TFT, the electric potential at the pixel electrode changes after the gate electrode is switched from an "on" state into the "off" state. This change in electric potential is called the kickback voltage. As mentioned above, one way of operating such a display device for reliable and optimal display drive is to bias the conductive front plane 3 at a voltage matching the kick-back voltage.

Figure 2:
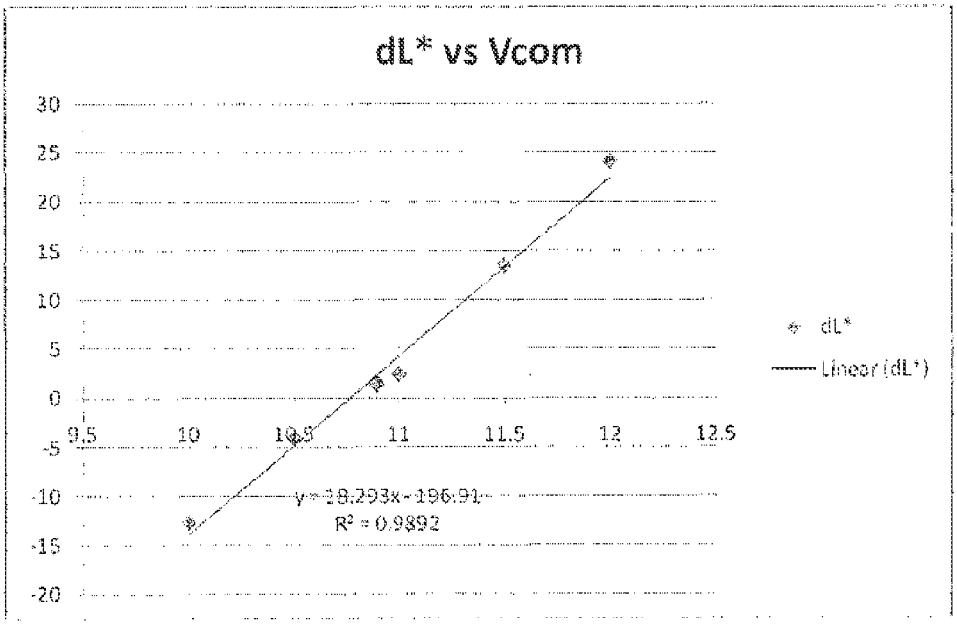
FIG. 2 illustrates a plot of luminance variation (dL) measurements in a technique according to an embodiment of the present invention.
Figure 3:
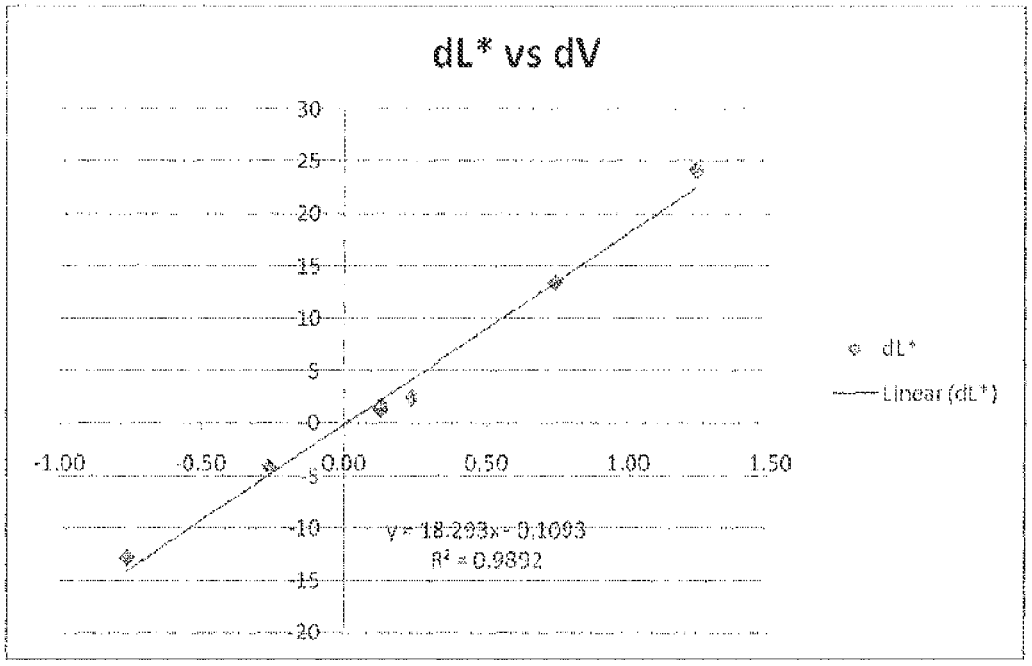
FIG. 3 illustrates an alternative plot of luminance variation (dL) measurements in a technique according to an embodiment of the present invention.

In this embodiment of the invention, the optical behaviour of the display device design is characterised in advance. In other words, how the luminance variation changes with changes in Vcom voltage for a display device design is characterised in advance. This characterisation is done by measuring how the luminance varies for a given length of test time for different Vcom voltages in one or more display devices having optical media with the same optical response. The choice of test time is a trade-off between achieving a high Vcom tuning accuracy and achieving an efficient testing process. The length of test time required to achieve a given degree of tuning accuracy will depend on the speed of response of the optical media—the slower the speed of response of the media, the longer the test time required to achieve a given tuning accuracy. From these measurements, a relationship can be derived for the display device design between a change in the Vcom voltage and a corresponding change in how the luminance varies. FIG. 2 illustrates a plot of luminance variation measurements for a number of different Vcom voltages. The display device design under measurement is seen to exhibit linear behaviour over the tested Vcom range. The luminance variation dL* is a measure of how the luminance varies over time due to a mismatch between the kickback voltage induced on the pixels and the COM voltage applied to the front plane COM driving the media. The kickback voltage is formed by the switching of the gate electrode from an on state to an off state. The relationship between luminance variation (dL*) and Vcom voltage derived from these measurements is expressed as a formula in FIG. 2, where y is the luminance variation and x is the Vcom voltage. The same measurement results are expressed in FIG. 3 as a plot of luminance variation (dL*) against the deviation of Vcom from Vcom for dL*=0, and as a formula in which y is the luminance variation (dL*) and x is the deviation of Vcom from Vcom for dL*=0.

Characterisation of the behaviour of the optical medium for the display device design can be extended for larger ranges of Vcom. It has been found, for this particular example of an optical medium (electrophoretic), that the dL* measurements for small deviations from the optimal Vcom voltage exhibit a linear relationship, whereas dL* measurements for large deviations from the optimal Vcom voltage start to deviate from this linear relationship. For non-linear relationships, a polynomial fit is found to provide an accurate expression of the relationship between luminance variation and the Vcom voltage.

The second part of the technique involves tuning the Vcom drive voltage for a specific device according to the same design for which the above-described characterisation was made. A single measurement of dL* is made for an arbitrary Vcom drive voltage; and the Vcom drive voltage is adjusted by the amount that the general relationship derived from the characterisation measurements described above indicates is necessary to go from the dL* measured at said arbitrary Vcom drive voltage to dL*=0. According to one variation, a roughly-tuned Vcom drive voltage determined by the kind of electrical method described above could be used instead of an arbitrary Vcom drive voltage.

This technique has been found to be more accurate than the electrical method described above in the introductory portion of this specification. This improvement in accuracy is thought to be due to the difficulty in achieving complete electrical isolation of the front conductive COM plane because of leakage pathways that are significant when the COM plane is not being driven. Another advantage of the above-described optical technique over the above-described electrical technique is that the measurements relate to the key section of the display device only, i.e. the visual display area, and are not influenced by any non-uniformities/defects outside this key section for which it is not necessary to take corrective action.

Also, with the technique described above, the process of tuning the Vcom drive voltage of a device is relatively quick because only a single measurement of dL* is made on the device whose Vcom drive voltage is to be tuned.

We have chosen the example of an electrophoretic display medium to describe a technique according to an embodiment of the present invention, but the same technique is also applicable to other types of display devices.

In addition to any modifications explicitly mentioned above, it will be evident to a person skilled in the art that various other modifications of the described embodiment may be made within the scope of the invention.

The invention claimed is:

1. A method, comprising:

determining a drive voltage correction for a front plane common electrode of a first display device having a display device design;

wherein the correction is determined according to:

(i) a result of one or more measurements of an optical property for the first display device and (ii) a result of one or more measurements of said optical property for one or more other devices having said display device design.

2. A method according to claim 1, further comprising:

determining from said measurements of said optical property for one or more other devices a relationship between a change in drive voltage for said front plane common electrode and a corresponding change in said optical property;

measuring said optical property for the first display device at a first drive voltage for said front plane common electrode; and determining a correction to the first drive voltage on the basis of said relationship.

3. A method according to claim 2, wherein said display device comprises a plurality of display pixels each controlled by a respective transistor including a gate electrode;

and said optical property is a variation in the luminance of one or more of said display pixels after switching the gate electrode from an on state to an off state.

4. A method according to claim 3, wherein said variation in luminance is due to a mismatch between a voltage induced on said one or more display pixels and said drive voltage applied to the front plane common electrode.

5. A method according to claim 1, wherein said relationship between a change in the drive voltage for said front plane common electrode and a corresponding change in said optical property is a linear relationship.

6. A method according to claim 1, wherein said relationship between a change in the drive voltage for said front plane common electrode and a corresponding change in said optical property is a non-linear relationship.

7. A method according to claim 1, wherein said first drive voltage is selected according to the result of a measurement of an electrical property for the first display device.

8. A method, comprising:

measuring luminance variation over time at different front plane common drive voltages for one or more display devices having a display device design;

determining from said measurements a relationship between a change in a front plane common electrode drive voltage and a corresponding change in luminance variation over time;

measuring luminance variation over time at a first front plane common electrode drive voltage for another display device of said display device design; and determining on the basis of said relationship a correction to the first front plane common electrode drive voltage to minimize luminance variation over time for said another display device.

* * * * *